US005980404A

United States Patent [19]

Gentile

[11] Patent Number: 5,980,404

[45] Date of Patent: Nov. 9, 1999

[54] STREET HOCKEY STICK

[76] Inventor: Robert Gentile, 30 Wyman Rd., Billerica, Mass. 01821

[21] Appl. No.: 09/002,282

[22] Filed: Dec. 31, 1997

[51] Int. Cl.[6] ..... A63B 59/14; F21V 33/00

[52] U.S. Cl. ..... 473/560; 473/220; 273/129 K; 273/199 R

[58] Field of Search ..... 273/129 K, 129 R, 273/DIG. 24; 473/558, 559, 560, 561, 562, 563, 564, 565, FOR 132, 220

[56] References Cited

U.S. PATENT DOCUMENTS

| | | | |
|---|---|---|---|
| 3,191,939 | 6/1965 | Hooper | 473/220 |
| 3,489,412 | 1/1970 | Franck et al. | 473/563 |
| 3,563,546 | 2/1971 | Dawe | 473/563 |
| 4,799,682 | 1/1989 | Hughes . | |
| 5,467,991 | 11/1995 | White, IV et al. | 473/220 |
| 5,470,072 | 11/1995 | Cunningham | 473/220 |
| 5,582,405 | 12/1996 | Montgomery . | |
| 5,788,582 | 8/1998 | Shapiro | 473/220 |
| 5,788,588 | 8/1998 | Hooker | 473/220 |
| 5,860,871 | 1/1999 | Marley, Jr. | 473/220 |

*Primary Examiner*—Jessica J. Harrison
*Assistant Examiner*—John Hotaling
*Attorney, Agent, or Firm*—O'Connell Law Firm

[57] ABSTRACT

A hockey blade for a hockey stick for striking a game projectile during hockey play. The preferred hockey blade has horizontal arcuate channels disposed on each of a first striking face and a second striking face of a projectile striking member whereby the striking faces of the hockey blade demonstrate improved control over a spherical game projectile. A plurality of vertical score lines may be disposed on one or both striking faces of the hockey blade. First and second light sources, each emitting a different light signal, may be operably associated with the first and second sides respectively of the hockey blade whereby the first and second sides can be readily distinguished. A plurality of ridges comprising rotatably coupled spherical balls may be disposed on a bottom face of the projectile striking member. The spherical balls may be removably coupled to the projectile striking member by a removable sleeve.

11 Claims, 4 Drawing Sheets

STREET HOCKEY STICK

FIELD OF THE INVENTION

The present invention relates generally to sports devices. More specifically, the present invention is directed to a street hockey stick for striking a game projectile during street hockey play.

BACKGROUND OF THE INVENTION

Prior art hockey sticks essentially comprise a handle coupled to a blade. The handle and blade may be formed integrally as a single unit, or the two may be disengagably coupled by a male/female connection. Hockey stick handles and hockey blades can be crafted from a wide variety of materials including laminated wood, plastic, aluminum, graphite, and composite materials such as fiberglass. Standard hockey blades may be either neutral or curved. Neutral hockey blades are substantially straight while curved hockey blades display a longitudinal concave curve on a forehand striking face and a corresponding longitudinal convex curve on an opposite backhand striking face. Such traditional curved hockey stick blades have been noted to enjoy added control from the forehand striking face but suffer from reduced control on the backhand striking face.

Relatively recent improvements in hockey sticks disclose hockey stick blades with longitudinal concave curves on both the forehand striking face and the backhand striking face. (See, e.g., U.S. Pat. No. 5,582,405 to Montgomery.) Other hockey stick blades have been disclosed that have bifurcated toe portions whereby both striking faces present a longitudinal concave curve. (See, e.g., U.S. Pat. No. 4,799,682 to Hughes.) These and other devices are said to improve a player's control of a hockey puck on both the forehand and backhand striking faces.

In recent years, however, hockey sports wherein the game projectile is a ball instead of a puck have become increasingly popular. Present-day street hockey is played not only on streets but also in specially-constructed indoor rinks. Furthermore, the more recently developed sport of roller hockey continues to grow in popularity. Unfortunately, hockey sticks have failed to adapt accordingly to these hockey sports wherein the game projectile is spherical instead of flat and round. Furthermore, hockey sticks have not satisfactorily addressed the change in playing surface from ice to wood, pavement, or cement.

For example, the vertically flat striking faces of present day hockey sticks may be ideal for striking a flat-edged hockey puck, but they exhibit a number of disadvantages when employed to play hockey with a spherical hockey ball. One major disadvantage that is exhibited when a player seeks to stop a moving ball derives from the fact that a hockey ball rolls and does not slide as does a hockey puck. As a result, hockey balls rolling along a playing surface with significant rotary kinetic energy often climb up and roll over the striking face of the hockey blade whereby the player controlling that stick is unable to stop the ball. Furthermore, players using a stick with a vertically flat striking face often find it difficult to direct a vertically bouncing ball toward the ground where it can be controlled and struck. Still further, roller hockey and street hockey players often find that hockey blades with vertically flat striking faces often wedge a ball between the ground and the stick face when a player attempts to strike the ball such as in a slap shot. These and further disadvantages derive from present day hockey blades' being ill adapted for use with the spherical balls of roller hockey and street hockey.

Certainly, a hockey blade that presenting a solution to one or more of the aforementioned problems would be useful. However, a hockey blade that solved all of the aforementioned problems while providing a number of heretofore unrealized advantages would represent a marked advance in the art.

SUMMARY OF THE INVENTION

In light of the above-described state of the prior art, a few objects and advantages of the present invention are worth particular mention. For example, it advantageously is a principal object of the present invention to provide a hockey blade for a hockey stick that is particularly adapted for use with a spherical hockey ball. The invention also is intended to improve a hockey player's ability to stop and control a hockey ball as the player seeks to stop, handle, and shoot or pass the ball. The invention also strives to provide a hockey blade that simulates the activity of a vertically-curved snowplow blade as it produces a wave of snow to cause the inventive hockey blade to induce a hockey ball to roll as it is pushed and struck by the hockey blade thereby producing a number of benefits including added control and a reduction in the likelihood that a hockey ball will become wedged between the hockey blade and the ground. Still further, preferred embodiments of the invention are designed to improve a player's control still further and to allow the player to induce a lateral spin in a hockey ball. The invention is designed to provide the aforementioned benefits on both striking faces of a hockey blade even where the blade demonstrates a longitudinal curve. The invention also seeks to enable a hockey player to attract attention to the hockey player's hockey stick selectively and to attract attention to the hockey player's stick automatically when the hockey blade experiences an impact (i.e., when a player strikes a ball or the playing surface with the hockey stick). A related object of the invention is to enable other hockey player's to distinguish readily between a first striking face and a second striking face of the hockey stick. Certainly, these and other objects and advantages of the present invention will become obvious to one who reads this specification and reviews the accompanying drawings.

In accomplishing the aforementioned objects, the present invention for a hockey blade essentially comprises an elongate projectile striking member with a first striking face with an upper edge and a lower edge, a second striking face with an upper edge and a lower edge, and a horizontal arcuate channel defined by an upper edge and a lower edge disposed on at least a portion of the first striking face. In a preferred embodiment, the upper edge of the arcuate channel is coincident with the upper edge of the first striking face, and the lower edge of the arcuate channel is coincident with the lower edge of the first striking face. Although such an embodiment of the invention accomplishes a number of the objects of the invention, greater advantage can be achieved by disposing a horizontal arcuate channel on the second striking face whereby both striking faces will provide a player with added control over the hockey ball. Further control can be realized by disposing a plurality of vertical score lines on at least the first striking face. Advantageously, the vertical score lines allow a player to induce a lateral spin to the ball while not resisting or slowing down forward movement of the ball as might texturing or knurling.

The projectile striking member may be straight with the upper edges of both arcuate channels coincident with the upper edges of the respective striking faces and both lower edges of the arcuate channels coincident with the lower edges of respective striking faces. Alternatively, the projectile striking member may be horizontally curved in which case the upper and lower edges of the arcuate channel on the first striking face may be coincident with the upper and lower edges of the first striking face while the upper edge of the arcuate channel on the second striking face is below the upper edge of the second striking face and the lower edge of the arcuate channel on the second striking face is above the lower edge of the second striking face. Under such an arrangement, the invention is able to provide improved handling of a street hockey ball on both sides of the striking member while not requiring unwieldy thickness that might be required if both curves started at the edges of the striking faces.

Since the hockey blade of the present invention is particularly designed for use with street hockey balls, at least the first striking face of an ideal hockey blade will have a horizontal arcuate channel with a horizontal midline that is approximately the same height as the midline of a street hockey ball. Since standard street hockey balls are approximately 2.6 inches in diameter, a preferred arcuate channel will have a horizontal midline that is between approximately 1 and 1.5 inches above the lower edge above the lower edge of the first striking face while an ideal arcuate channel will have a horizontal midline that is approximately 1.3 inches above the lower edge of the first striking face.

The preferred embodiment of the street hockey blade also accommodates the change in playing surface from ice to other surfaces such as pavement or cement. Although traditional hockey stick blades slide effortlessly over ice, other playing surfaces provide disadvantageous resistance to movement of the street hockey blade thereover. Advantageously, the present invention reduces this resistance by providing a plurality of ridges disposed on a bottom face of the hockey blade that act to reduce surface contact between the street hockey blade and a playing surface on which the blade is used. Although the ridges may be formed integrally with the projectile striking member, they alternatively may be formed of a different material. For example, the ridges may comprise spherical balls that are rotatably retained on the bottom face of the projectile striking member. Furthermore, the ridges may be formed of a material of increased durability and which demonstrates a low coefficient of friction relative to a playing surface. For example, the ridges may comprise hard plastic or metal ball bearings.

To attract attention to the hockey blade during hockey play, a first light source along with a power source therefor may be operably associated with the hockey blade. The hockey blade may include further a means for automatically activating the first light source in response to an impact on the hockey blade, and there may additionally or alternatively be included a means for selectively activating the first light source. Such an arrangement provides a number of benefits. For example, a player can strike the stick against a playing surface to activate the first light source and to indicate that he or she, for example, is open to receive a pass. Furthermore, the first light source will be activated when a player strikes a game projectile whereby other players are immediately alerted that the game projectile has been struck.

Although one light source certainly provides a number of heretofore unrealized advantages, the inventor has discovered that including a second light source and disposing the first and second light sources on opposite first and second sides of the hockey blade provides still further advantage. For example, the first and second light sources can emit different light signals (i.e., different colors) so that another player can readily determine which side of the stick he or she is viewing. The light source and power source may be fixedly coupled with the hockey stick blade (i.e., retained therewithin except for the light source), or the means for coupling the first light source and the power source to a hockey stick may comprise any appropriate means such as glue, tape, or a band for surrounding a portion of a hockey stick.

The foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF A PREFERRED EMBODIMENT

Figure 1:
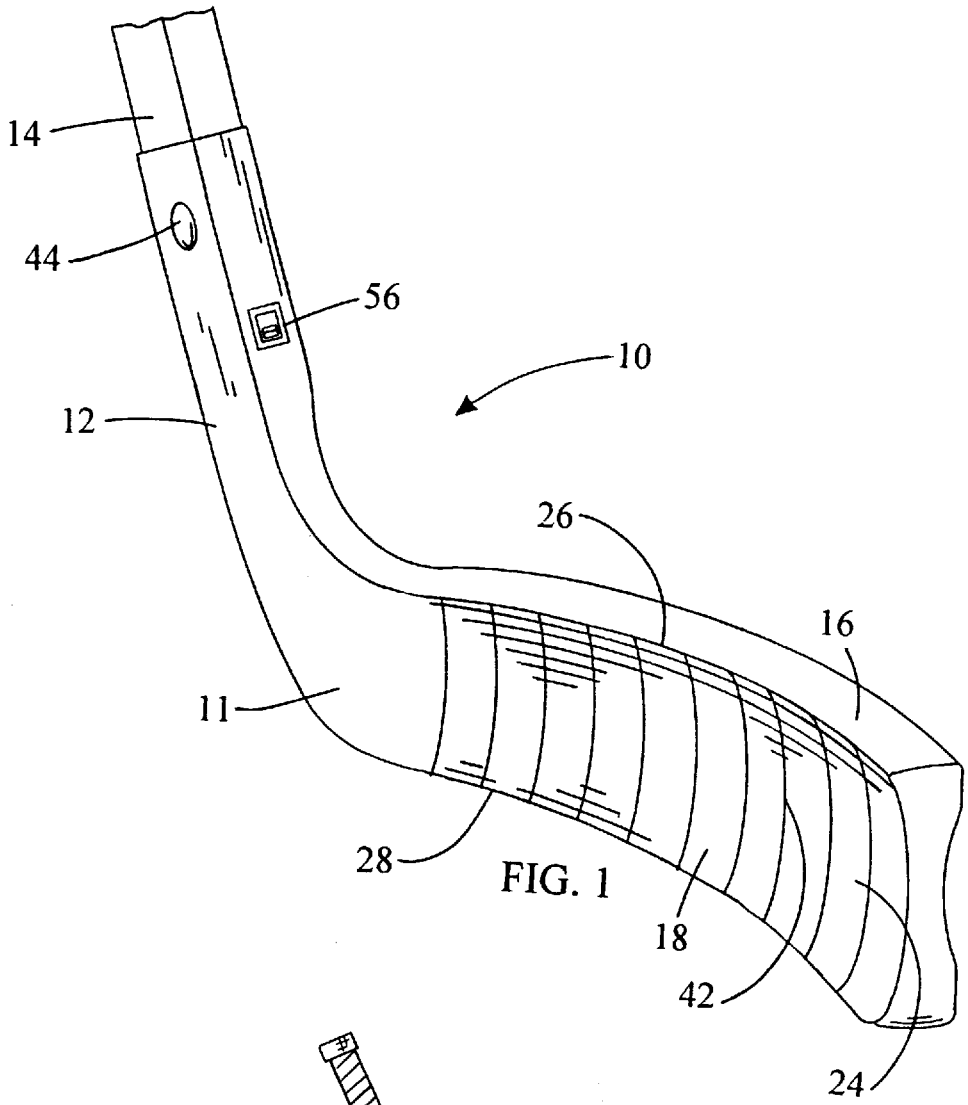
FIG. 1 is a perspective view of a street hockey blade embodying the present invention shown coupled to a hockey stick handle.
Figure 2:
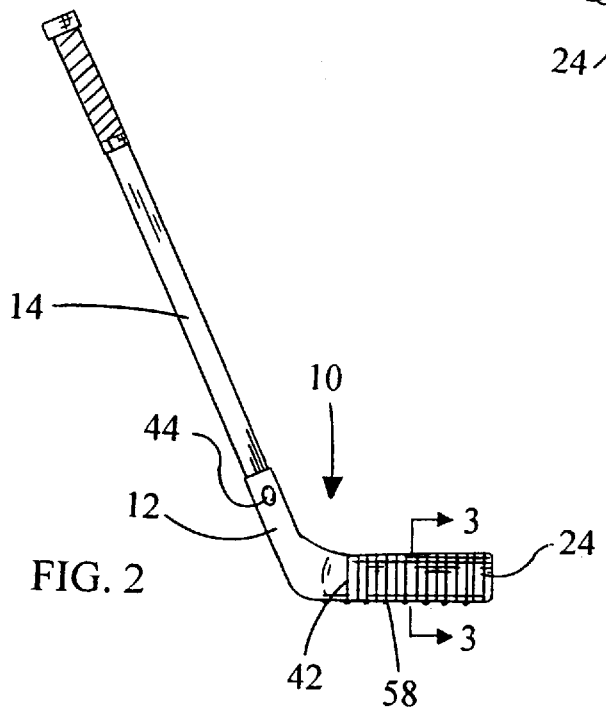
FIG. 2 is a view in front elevation of the street hockey blade of FIG. 1.

Looking more particularly to the drawings, FIG. 1 shows a street hockey blade 12 embodying the present invention. The street hockey blade 12 is coupled to a hockey stick handle 14 whereby the street hockey blade 12 and the hockey stick handle 14 together comprise a street hockey stick 10. The street hockey blade 12 includes an elongate projectile striking member 16 that has a first striking face 18 and a second striking face 20, which can be seen most clearly in FIG. 4. As is commonly found in the prior art, the projectile striking member 16 of the embodiment of the invention shown in FIGS. 1–4 is horizontally curved to suit a particular hand dominance such that the first striking face 18 presents a forehand side 18 and the second striking face 20 presents a backhand side 20.

It should be made clear that although the street hockey blade 12 and the hockey stick handle 14 are shown as matingly engaged in the preferred embodiments of the invention disclosed herein, it is certainly within the scope of the present invention to form the street hockey blade 12 and the hockey stick handle as an integral unit. It also should be made explicit at the outset that throughout the present specification and claims spatial indications shall be used assuming that the street hockey stick 10 is in an upright position in the figures. Consequently, such words as "upper" shall mean above in location in the figure, and such words as "lower" shall mean below in location in the figure.

With this in mind and looking to the embodiment of the invention shown in FIGS. 1–4, one sees that the first striking face 18 of the present street hockey blade 12 is not vertically flat as are striking faces found in prior art hockey stick blades (not shown). Instead, the first striking face 18 has a vertical curve 22 disposed over substantially its entire length that thereby forms a horizontal arcuate channel 24. The horizontal arcuate channel 24 has an upper edge 26 that is coincident with an upper edge of the first striking face 18, which also is indicated at 26. Similarly, a lower edge 28 of the horizontal arcuate channel 24 also is coincident with a lower edge 28 of the first striking face 18.

Figure 3:
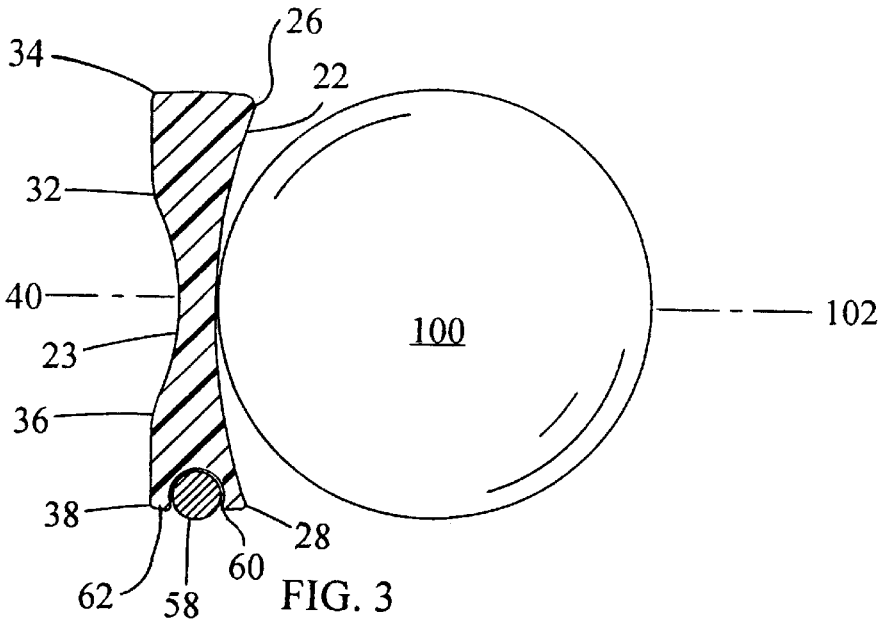
FIG. 3 is a view in cross section of a street hockey blade according to the present invention taken along the line 3—3 in FIG. 2 shown adjacent to a standard street hockey ball.
Figure 4:
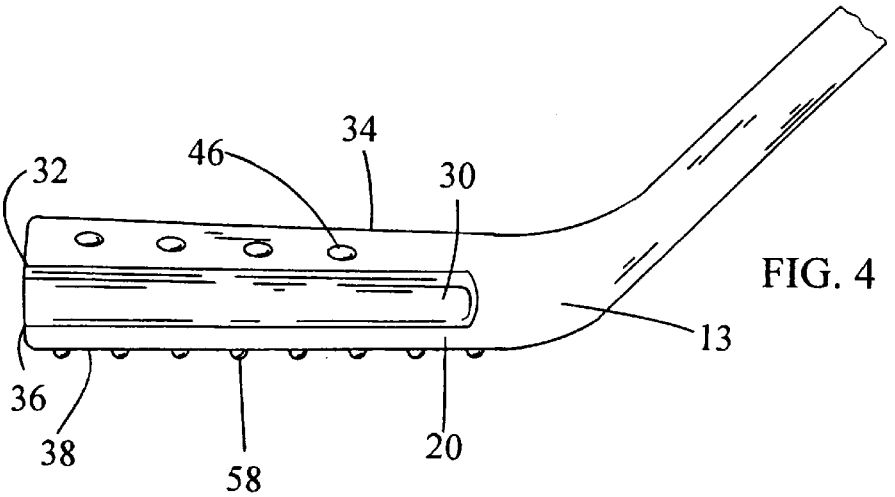
FIG. 4 is a view in rear elevation of the street hockey blade of FIG. 1.

As FIGS. 3 and 4 show most clearly, the second striking face 20 of the projectile striking member 16 has a vertical curve 23 disposed over substantially its entire length that thereby forms a horizontal arcuate channel 30. Unlike the horizontal arcuate channel 24 of the first striking face 18, the horizontal arcuate channel 30 of the second striking face 20 has an upper edge 32 that is below the upper edge 34 of the second striking face 20, and a lower edge 36 that is above a lower edge 38 of the second striking face 20.

Of course, variations in the relative locations of the upper and lower edges 26, 32, 28, and 36 of the horizontal arcuate channels 24 and 30 are well within the scope of the present invention. For example, one may look to FIG. 5 where an alternative embodiment of the invention is shown in cross section. In that embodiment, the projectile striking member 16 is straight whereby the street hockey blade 12 is suitable for players of either hand dominance and the striking faces 18 and 20 may be used equally. Consequently, the first and second striking faces 18 and 20 have substantially identical vertical curves 22, 23 that define the horizontal arcuate channels 24, 30. Each arcuate channel 24, 30 has an upper edge 26, 32 that is coincident with the upper edge 26, 34 of the first striking face 18 and the second striking face 20, and each arcuate channel 24, 30 has a lower edge 28, 36 that is coincident with the lower edge 28, 38 of first striking face 18 and the second striking face 20.

Each of the horizontal arcuate channels 24 and 30 has a horizontal midline 40 about which the horizontal arcuate channels 24 and 30 are substantially symmetrical. Since the street hockey blade 12 is particularly adapted for use with a street hockey ball such as that shown at 100 in FIG. 3, the horizontal midlines 40 of these most preferred embodiments are approximately equal in height as the midline 102 of the street hockey ball 100. Consequently, the first striking face 18 and the second striking face 20 add to a player's control over a street hockey ball 100 while tending to hit a ball squarely and neither pressing the street hockey ball 100 downward nor unintentionally causing the street hockey ball 100 to lift. With this in mind and since standard street hockey balls 100 have a diameter of approximately 2.6 inches and thus a horizontal midline 102 that is approximately 1.3 inches above a playing surface (not shown), the horizontal midlines 40 of the horizontal arcuate channels 24 and 30 also are approximately 1.3 inches above the lower edges 28 and 38 of the first and second striking faces 18 and 20 and thus a playing surface. Furthermore, in this preferred embodiment, each vertical curve 22, 23 (and consequently the arcuate channels 24 and 30) has a generally consistent radius of curvature that is greater than the 1.3 inch radius of curvature of a standard street hockey ball 110. As a result, a street hockey ball 100 can be cupped and controlled by the arcuate channels 24 and 30 without being wedged or trapped therein. Of course, where other game projectiles are used, it may be preferable to vary the radius of curvature accordingly.

By the provision of the horizontal arcuate channels 24 and 30, the present street hockey blade 12 certainly provides a player who plays with a spherical street hockey ball 100 with improved control over prior art hockey sticks. However, the present invention provides a player with still greater control over a game projectile such as the street hockey ball 100, by the provision of a plurality of vertical score lines 42 disposed on at least the first striking face 18. The plurality of vertical score lines 42 allow a player to induce a lateral spin on a game projectile such as the street hockey ball 100. Advantageously, however, they do not interfere with the forward progress of a street hockey ball 100 as would surface texturing or knurling.

Figure 5:
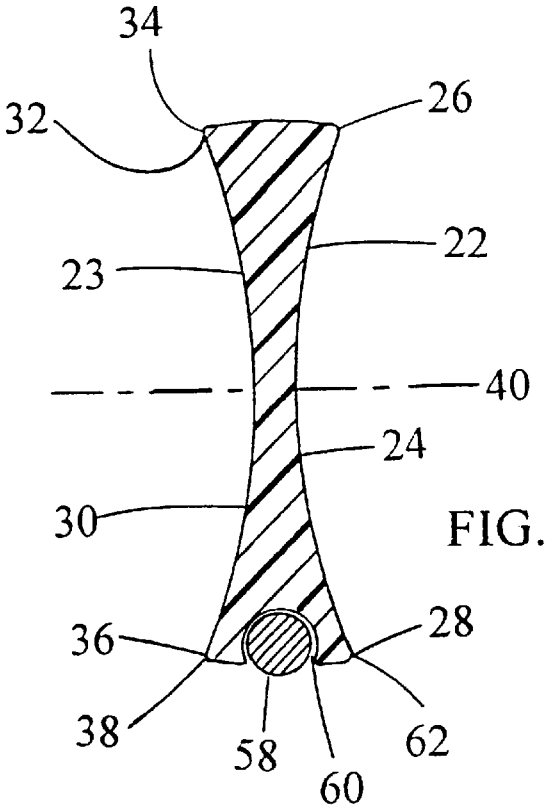
FIG. 5 is a view in cross section of an alternative street hockey blade according to the present invention.
Figure 8:
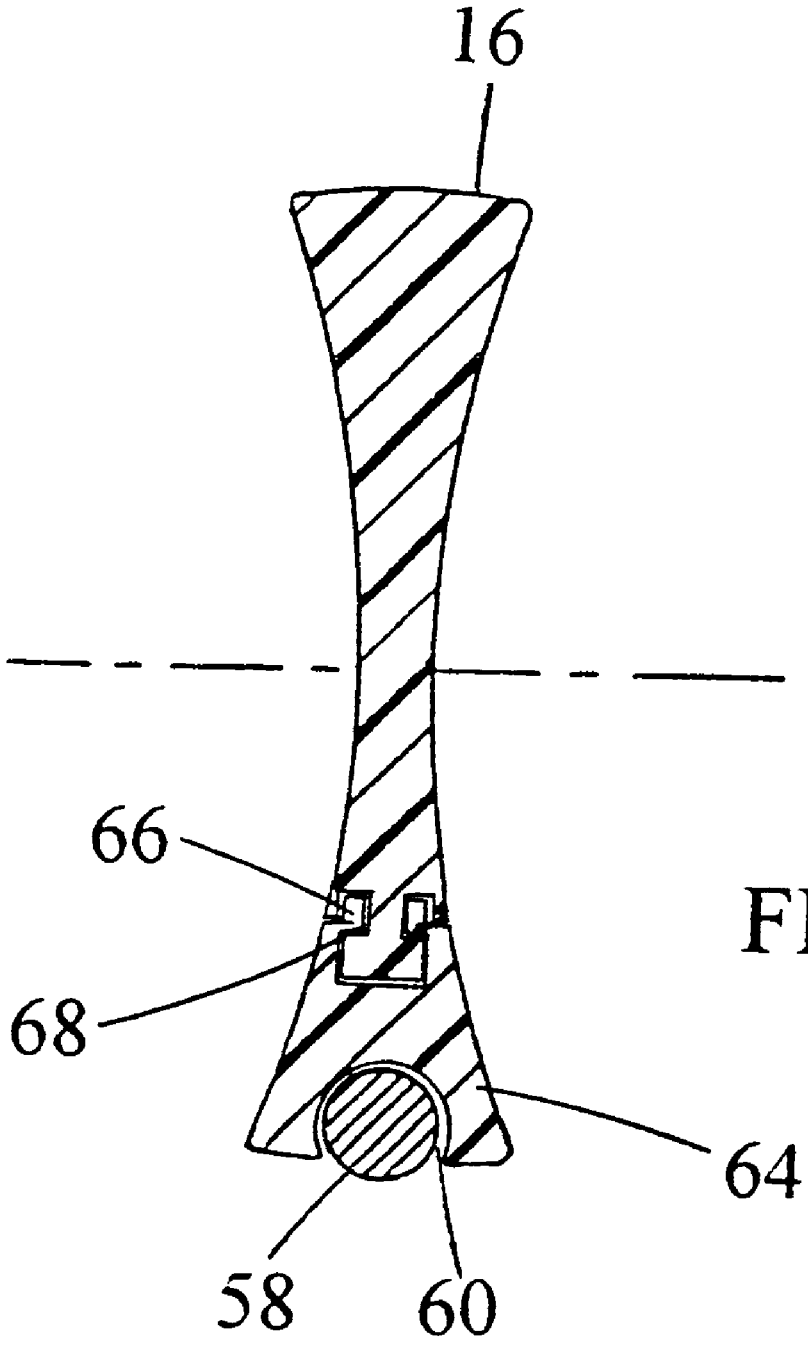
FIG. 8 is a view in side elevation of another alternative street hockey blade according to the present invention.

Advantageously, as FIGS. 3, 5, and 8 show most clearly, the present invention further comprises a plurality of ridges, each comprising a spherical ball 58, disposed on a bottom face 62 of the projectile striking member 16. The spherical balls 58 reduce resistance to movement of the street hockey blade 12 over a non-illustrated playing surface on which the hockey stick 10 is used by rolling over the playing surface and reducing surface contact area. Each spherical ball 58 is rotatably retained on the bottom face 62 of the projectile striking member 16 within a cavity 60. The spherical balls 58 may be formed of any suitable material. For example, for increased durability and reduced frictional resistance, the spherical balls 58 may be formed of a hard plastic or a metal. Nonetheless, it is likely that the spherical balls 58 or any other type of ridge would demonstrate wear after a certain amount of use. With this in mind, another embodiment of the invention, which is shown in FIG. 8, shows the spherical balls 58 to be retained by a sleeve 64 that forms a removably coupled bottom portion of the projectile striking member 16 by employing a slidable connection between a pair of opposed ridges 66 on the sleeve 64 and a pair of corresponding opposed grooves 68 in the projectile striking member 16.

These most preferred embodiments of the present street hockey stick 10 further include a first light source 44 disposed on a first side 11 of the street hockey blade 12 and a second light source 46 disposed on a second side 13 of the street hockey blade 12. Each of the first and second light sources 44 and 46 comprises at least one shielded bulb. Certainly, either or both light sources 44 or 46 may comprise a multiplicity of shielded bulbs. Although in the embodiment of the invention shown in FIGS. 1, 2, and 4 the first light source 44 and the second light source 46 are shown to be embedded within the street hockey blade 12, certainly it is within the scope of the present invention to attach the first light source 44 and the second light source 46 by any appropriate means such as a band 48 with a hook and loop attaching mechanism 50 as is shown in FIGS. 6 and 7.

Figure 6:
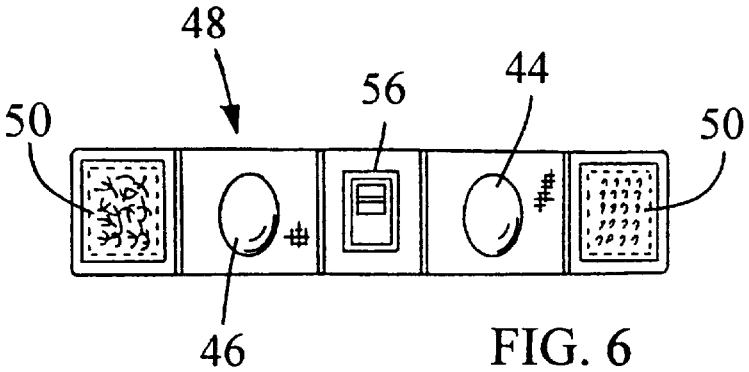
FIG. 6 is a view in front elevation of a device according to the present invention for causing a hockey stick to emit light for attracting attention to the hockey stick during hockey play.
Figure 7:
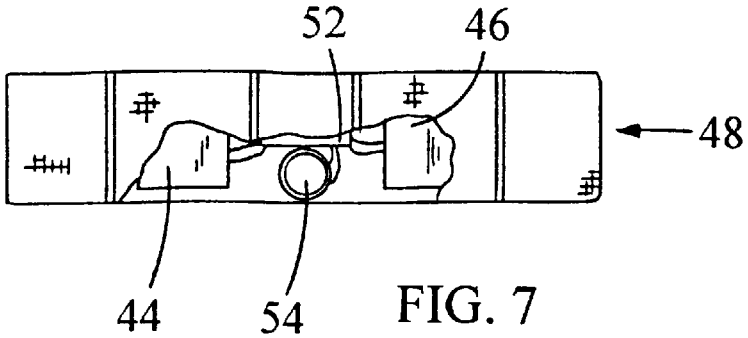
FIG. 7 is a partially sectioned view in rear elevation of the device of FIG. 6.

Since in each embodiment the mechanisms for activating the first and second light sources 44 and 46 are substantially the same and since a majority of the mechanism is formed within the hockey stick blade 12 in FIGS. 1–5, one may look most conveniently for an understanding of the lighting arrangement of the present invention to FIG. 6 and to FIG. 7 where the band 48 is partially sectioned away to reveal a printed circuit board 52 that is contained therewithin. A battery 54 is operably coupled to the circuit board 52 and to the first and second light sources 44 and 46 to act as a power source therefor. A means for automatically activating the first and second light sources 44 and 46 in response to an impact on the hockey blade 12 is operably coupled to the first and second light sources 44 and 46. In this embodiment, the means for automatically activating the first and second light sources 44 and 46 is incorporated into the circuit board 52. However, the means for automatically activating the first and second light sources 44 and 46 may be of any of the designs that are now or may come to be known to the art. For example, the automatic activating means may be modeled after that disclosed in U.S. Pat. No. 5,066,011 for a Flashing Light Ball, U.S. Pat. No. 5,236,383 for a Illuminated Toy Ball, or U.S. Pat. No. 5,408,764 for a Motion Activated Illuminating Footwear and Light Module Therefor. Therefore, each of these disclosures is expressly incorporated herein by reference. However, since a player may wish for the first and second light sources 44 and 46 to be continuously activated during hockey play, the invention further includes an on/off switch 56 that is operably coupled to the first and second light sources 44 and 46 whereby the on/off switch 56 acts as a means for selectively activating the first and second light sources 44 and 46.

It is most preferable that the first and second light sources 44 and 46 emit different light signals when activated whereby other players may be able to determine which side 11 or 13 of the hockey blade 12 is facing them. As a result, in these most preferred embodiments, the first light source 44 emits a light signal of a first color (i.e., green) while the second light source 46 emits a light signal of a second color (i.e., red). However, it should be clear that the term different light signals does not require that the first and light sources 44 and 46 emit different colors. For example, it would provide sufficient differentiation if the first and second light sources 44 and 46 were of different shapes or if one or each comprised a multiplicity of bulbs arranged in different configurations even if the first and second light sources 44 and 46 emitted light of the same color. For example, one sees that the first light source 44 comprises a single bulb in a given position in FIG. 1 while the second light source 46 comprises a multiplicity of light bulbs in a different position in FIG. 4. Any sufficient difference in light signal characteristic, number, or location would be sufficient to allow a player to differentiate between the first light source 44 and the second light source 46. Consequently, the term different light signal should be considered to include any sufficient difference in light signal that would allow differentiation between the first and second sides 11 and 13 of the street hockey blade 12.

From the foregoing, one skilled in the art will realize that the present invention for a street hockey blade 12 is particularly adapted for use with a spherical street hockey ball 100 and for the environment and circumstances under which street hockey sticks are used. As a result, the street hockey blade 12 achieves a multiplicity of advantages over prior art hockey stick blades. For example, with the provision of first and second arcuate channels 24 and 30, the hockey blade 12 improves a hockey player's ability to stop and control a hockey ball 100 as the hockey ball 100 is cupped and controlled and the hockey blade 12 simulates the activity of a vertically-curved snowplow blade producing a wave of snow. Additionally, the vertical score lines 42 further improve a player's control by allowing the player to induce a lateral spin in a hockey ball 100. Also, a hockey player can employ the first and second light sources 44 and 46 to attract attention to the hockey player's hockey stick 10 selectively or automatically upon impact of the stick 10 with an outside object. Furthermore, frictional resistance of the hockey blade 12 relative to a playing surface is reduced while the durability of the hockey blade 12 is increased by the provision of the rotatably retained spherical balls 58, which may be removable where a sleeve 64 is employed. Certainly, these and other objects and advantages of the present invention will become obvious to one who reads this specification and reviews the accompanying drawings.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim:

1. A hockey blade for a hockey stick for striking a game projectile during hockey play, the hockey blade comprising an elongate projectile striking member with a first striking face defined by a first striking face upper edge and a first striking face lower edge; a second striking face defined by a second striking face upper edge and a second striking face lower edge; a substantially horizontal arcuate channel disposed on the first striking face defined by an arcuate channel upper edge that is substantially coincident with the first striking face upper edge, an arcuate channel lower edge that is substantially coincident with the first striking face lower edge, and a substantially smooth curve with a consistent radius located between the arcuate channel upper and lower edges; a substantially horizontal arcuate channel disposed on the second striking face defined by an arcuate channel upper edge that is removed from the second striking face upper edge, an arcuate channel lower edge that is removed from the second striking face lower edge, and a smooth curve with a consistent radius disposed between the arcuate channel upper edge and the arcuate channel lower edge.

2. The hockey blade of claim 1 wherein the substantially horizontal arcuate channel of the first striking face has a horizontal midline that is between approximately one inch and approximately one and one-half inches above the first striking face lower edge.

3. The hockey blade of claim 2 wherein the horizontal midline of the substantially horizontal arcuate channel of the first striking face is approximately one and three-tenths inches above the first striking face lower edge.

4. A hockey blade for a hockey stick for striking a game projectile during hockey play, the hockey blade comprising an elongate projectile striking member with a first striking face and a second striking face, a first light source operably associated with the hockey blade for attracting attention to the hockey blade during hockey play, a power source for providing power to the first light source, and a means for automatically activating the first light source in response to an impact on the hockey blade.

5. The hockey blade of claim 4 further comprising a means for selectively activating the first light source.

6. The hockey blade of claim 4 further comprising a second light source operably associated with the hockey blade wherein the first light source is operably associated with a first side of the hockey blade and wherein the second light source is operably associated with a second side of the hockey blade.

7. The hockey blade of claim 6 wherein the first light source and the second light source emit different light signals when activated.

8. The hockey blade of claim 7 wherein the first light source emits a light signal of a first color and the second light source emits a light signal of a second color.

9. A device for causing a hockey stick to emit light to attract attention to the hockey stick during hockey play, the device comprising a hockey stick blade, a first light source, a power source, a means for coupling the first light source and the power source to the hockey stick blade, and a means for automatically activating the first light source in response to an impact on the hockey stick blade.

10. The device of claim 9 further comprising a second light source wherein the first light source is operably associated with a first side of the hockey stick blade, the second light source is operably associated with a second side of the hockey stick blade, and the first light source and the second light source emit different light signals when activated.

11. The device of claim 10 wherein the first light source emits a light signal of a first color and the second light source emits a light signal of a second color.

* * * * *